US005763872A

United States Patent [19]

Ness

[11] Patent Number: 5,763,872

[45] Date of Patent: Jun. 9, 1998

[54] MOTION ACTUATED NIGHT LIGHT

[76] Inventor: Ronald James Ness, 30041 Del Mar Ct., Temecula, Calif. 92592

[21] Appl. No.: 786,204

[22] Filed: Jan. 20, 1997

[51] Int. Cl.[6] ..... F21S 9/02; F21V 9/16; H05B 33/00

[52] U.S. Cl. ..... 250/214 AL; 250/221; 362/84; 362/191; 362/334; 362/368

[58] Field of Search ..... 250/205, 221, 250/239, 214 AL; 362/84, 157, 186, 190, 191, 194, 333, 362, 368, 398; 340/552, 555, 567, 693

[56] References Cited

U.S. PATENT DOCUMENTS

| | | | |
|---|---|---|---|
| 3,459,961 | 8/1969 | Ravas | 307/116 |
| 4,433,328 | 2/1984 | Saphir et al. | 340/555 |
| 4,450,351 | 5/1984 | Fraden | 250/221 |
| 4,514,789 | 4/1985 | Jester | 362/95 |
| 4,904,991 | 2/1990 | Jones | 340/815.15 |
| 5,015,994 | 5/1991 | Hoberman et al. | 340/567 |
| 5,036,443 | 7/1991 | Humble et al. | 362/183 |
| 5,136,476 | 8/1992 | Horn | 362/198 |
| 5,184,889 | 2/1993 | Vasquez | 362/276 |
| 5,251,391 | 10/1993 | Lan | 40/152.2 |
| 5,258,899 | 11/1993 | Chen | 362/394 |
| 5,309,145 | 5/1994 | Branch et al. | 340/540 |
| 5,317,488 | 5/1994 | Penrod | 362/84 |
| 5,381,323 | 1/1995 | Osteen et al. | 362/276 |
| 5,434,764 | 7/1995 | Lee et al. | 362/276 |
| 5,442,532 | 8/1995 | Boulos et al. | 362/276 |
| 5,548,494 | 8/1996 | Blackman | 362/183 |
| 5,618,100 | 4/1997 | Glynn | 362/183 |

*Primary Examiner*—Edward P. Westin
*Assistant Examiner*—John R. Lee
*Attorney, Agent, or Firm*—Gene Scott-Patent Law & Venture Group

[57] ABSTRACT

A night light device provides a low level illumination using electro-phosphorescent lighting which is automatically turned on when motion near the device is detected by the device and if the ambient lighting level is low. When the ambient light level is above a specified level so that it is possible to see without artificial light, the device is inactive. A high intensity lighting feature allows the device to be used as a flashlight in emergencies since the device is fastened to a wall in such a way that it is easily and quickly removed. The front face of the device provides a downwardly directed surface for projecting light toward the floor, and sideways directed surfaces for projecting light to each side. Spherical Fresnel lenses enable the device to detect motion over a 180 degree azimuth. The device may have phosphorescent doping within its case structure so as to provide a dim light even when not energized.

13 Claims, 2 Drawing Sheets

MOTION ACTUATED NIGHT LIGHT

BACKGROUND OF THE INVENTION

1. Field Of The Invention

This invention relates generally to low level illumination night lamps, beacons and signals for indicating walkways and such, and more particularly to a self contained night light having a motion detection means for controlling the switching of an illumination means so as to extend the life of an energy cell or battery.

2. Description of Related Art

The following art defines the present state of this field:

Saphir et al., U.S. Pat. No. 4,433,328, describes a moving object sensing processor responsive to slowly varying motions of a human being or other moving object in a zone of interest employs high frequency pulse modulated non-visible radiation generated by a radiation generating source, such as an LED, and detected by a detector sensitive to radiation of a preselected wavelength which generates electrical signals representative of the reflected radiation received from the zone of interest. The detector signals are processed to normalize the base level and remove variations due to background level changes, and slowly varying changes in the signals are detected by a bipolar threshold detector.

Fraden, U.S. Pat. No. 4,450,351, describes a motion detection system which utilizes a lens or other imaging device to be responsive to motion in a particular field of view in a room, for example, and pass illumination to a photocell. The photocell or a screen in front thereof establishes image distortion so that there is a nonuniform electrical output from the photocell upon motion of objects in the given field of view.

Lee et al., U.S. Pat. No. 5,434,764, describes a lighting fixture with infra-red responsive motion detector unit incorporated into the fixture design. The lighting fixture includes a motion detector housing forming an integral part of the lighting fixture body and having a generally convex shape fitting in the decorative styling of the fixture body.

Boulos et al., U.S. Pat. No. 5,442,532, describes decorative fixtures that enable azimuthal directivity of the infrared detector in order to adjust the directivity of the infrared detector about a vertical axis in a manner which is aesthetically compatible with the decorative nature of the fixture.

Chen, U.S. Pat. No. 5,258,899, describes a motion sensor lighting control that includes a hemispherical mounting plate having a pair of first circular apertures and a second circular aperture, a pair of lamp holders for receiving lamps therein rotatably mounted on the first circular apertures by a pair of first swivel devices, a sensor housing for receiving and infrared sensor rotatably mounted on the second circular aperture by a second swivel device.

Osteen et al., U.S. Pat. No. 5,381,323, describes a lighting fixture having a new and improved sensor housing and an adjustable mast arm. The sensor housing includes a top wall, a bottom wall, a back wall having a first lead aperture for establishing electrical and mechanical connections between a proximity sensor and a source of electrical power, a transition wall, a pair of side walls, and at least one drain aperture located between the transition wall and the bottom wall.

Ravas, U.S. Pat. No. 3,459,961, describes a device for controlling the application of power to a load in response to the movement of an object within a prescribed area.

Humble et al., U.S. Pat. No. 5,036,443, describes a proximity light that is provided and consists of a housing adhesively mounted to a flat surface such as a wall or the underside of a toilet seat cover. AN electrically operated light source is carried within the housing along with electronic circuitry for supplying electric current to energize the light source. A sensor switch is also carried within the housing and is connected between the electronic circuitry and the light source so as to close when it gets dark.

Horn, U.S. Pat. No. 5,136,476, describes an easily-installed, portable illuminator for the illuminating of a toilet bowls. More specifically, the illuminator hangs on the rim of a toilet bowl by a tubular conduit through which electrical conductors carry current from a battery pack or other power source external to the bowl. Light -sensitive and manual switches and current-regulating circuitry are options on advanced embodiments.

Jones, U.S. Pat. No. 4,904,991, describes a display unit that has a transparent front panel one surface of which carries reflective markings that are illuminated by internal reflection in the panel from edge-mounted bulbs. Behind the panel are located light-emitting display devices such as provided by LED's. Illumination from the bulbs is controlled manually adjusting a rheostat 36. The brightness of the display devices is controlled by means of two photo diodes. One photo diode responds to the level of ambient light falling on the front panel; the other photo diode is shielded from ambient light and responds to light from an additional bulb connected in parallel with the edge-mounted bulbs and having the same illumination characteristics. The brightness of the display devices is thereby automatically decreased when ambient light levels fall and increased when the markings are brightly illuminated, so that they are not masked by bright markings.

Jester, U.S. Pat. No. 4,514,789, describes a light switch plate having a rearwardly opening housing for removably holding an AA battery which is detachably mountable over a conventional wall mounted 110 volt AC light switch. An LED mounted on the front of the housing is connected to the battery through an integrated circuit oscillator which flashes the LED. A phototransistor is also mounted on the front of the housing of the LED except when the room is dark. The flashing LED provides an eye catching signal so that a person can more readily locate the light switch in the dark. The circuit has extremely lower current drain on the battery permitting operation for a year without requiring battery replacement.

Lan, U.S. No. 5,251,391, describes an illuminated photo frame, comprising: a transparent frame body constituted by elongated lines and cross lines respectively having a back side created with a plurality of integrated 45° prisms in more than one flight of stages to collectively form a certain pattern, a recess arranged at the back side of the naturally met elongated and cross lines in cross opposition to the other for installing a small bulb each thereat, and a photoresistance in control of electricity supply to small bulbs to have them transmit lights automatically at night, which sent from two sides of each recess to travel forward alongside elongated and cross lines will make an internal total reflection at each 45° slant of the prism to project out of the front side, thereby, with a crystal illumination given to the pattern. And the electricity supply will automatically cease at daytime.

Vasquez, U.S. 5,184,889, describes an indicator light which is arranged for actuation upon vibration imparted to the light housing. A mercury switch cooperates with a first switch to effect actuation of the light, with the mercury switch arranged for effecting contact. Further, the housing is arranged to include a pin member displaced within the housing upon vibration being imparted to the housing and pin member.

The prior art teaches the use of motion sensing and lighting devices. However, the prior art does not teach a wall mounted night light having specifically, downward and sidewards directed lighting surfaces, and a 180 degree sensor reception azimuth, and a low level electro-phosphorescent contoured panel for favorable light transmission through a housing wall in selected directions. The present invention fulfills these needs and provides further related advantages as described in the following summary.

SUMMARY OF THE INVENTION

The present invention teaches certain benefits in construction and use which give rise to the objectives described below.

The present invention provides a night light device having a low level illumination using electro-luminescent lighting which is automatically turned on when motion near the device is detected by the device and if the ambient lighting level is low. When the ambient light level is above a specified level so that it is possible to see without artificial light, the device is inactive. A high intensity lighting feature allows the device to be used as a flashlight in emergencies such as fires, earthquakes and power outages, since the device is fastened to a wall in such a way that it is easily and quickly removed. The front face of the device provides a downwardly directed surface for projecting light toward the floor, and sideways directed surfaces for projecting light to each side. Lighting from the device is optimal when the lamp is positioned approximately 18inches above the floor level and is of such a level as to safely guide a person walking in total darkness. Spherical Fresnel lenses enable the device to detect motion over a 180 degree azimuth. The device may have phosphorescent doping within its case structure so as to provide a dim light even when not energized. The device may be used for lighting a corridor or other path at night and can be used as an intrusion alert at home, office or when camping. The low level lighting from the device is effective over about a 15foot radius so that in a corridor the units would be spaced in 30foot intervals.

A primary objective of the present invention is to provide an improved night light having advantages not taught by the prior art.

Another objective is to provide such a night light wherein a low level lighting is produced and directed to specific directions for efficient light effects. This objective is achieved by the novel shape of the housing of the instant invention and by the novel contoured lighting plate nestled within the housing.

A further objective is to provide such a night light wherein a bright illumination source is available for use of the device as a flashlight for emergencies.

A still further objective is to provide such a night light wherein a phosphorescent material provides dim lighting when the device is in the off state.

Another objective is to provide such a night light having the ability to sense motion over a 180 azimuth.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE PREFERRED EMBODIMENT

Figure 1:
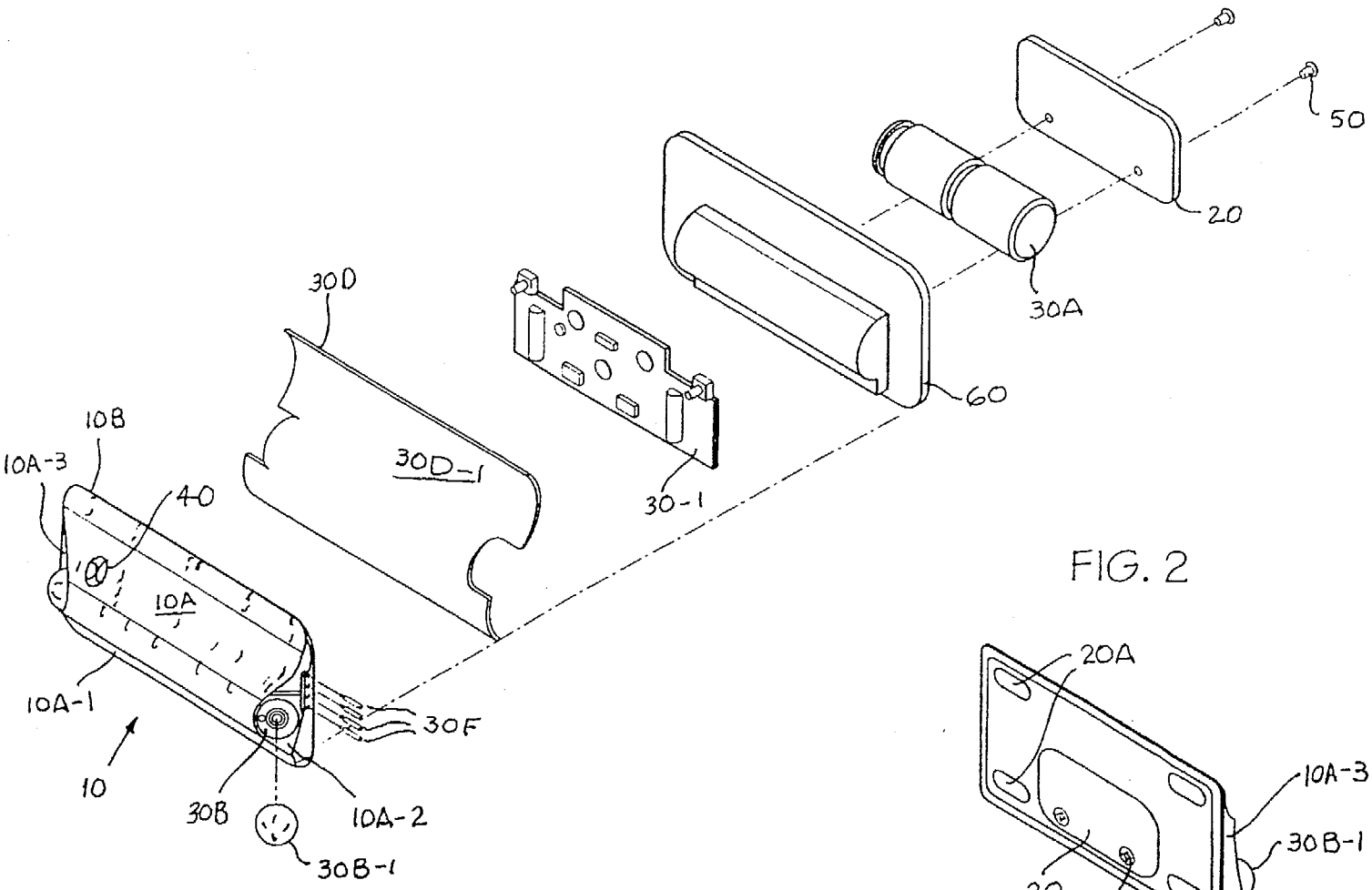
FIG. 1 is an exploded perspective front quarter view of the preferred embodiment of the present invention.
Figure 2:
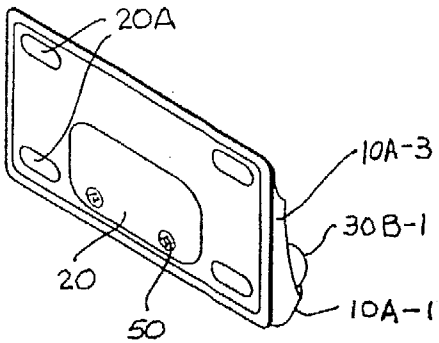
FIG. 2 is a perspective rear quarter view thereof showing the invention as assembled.
Figure 3:
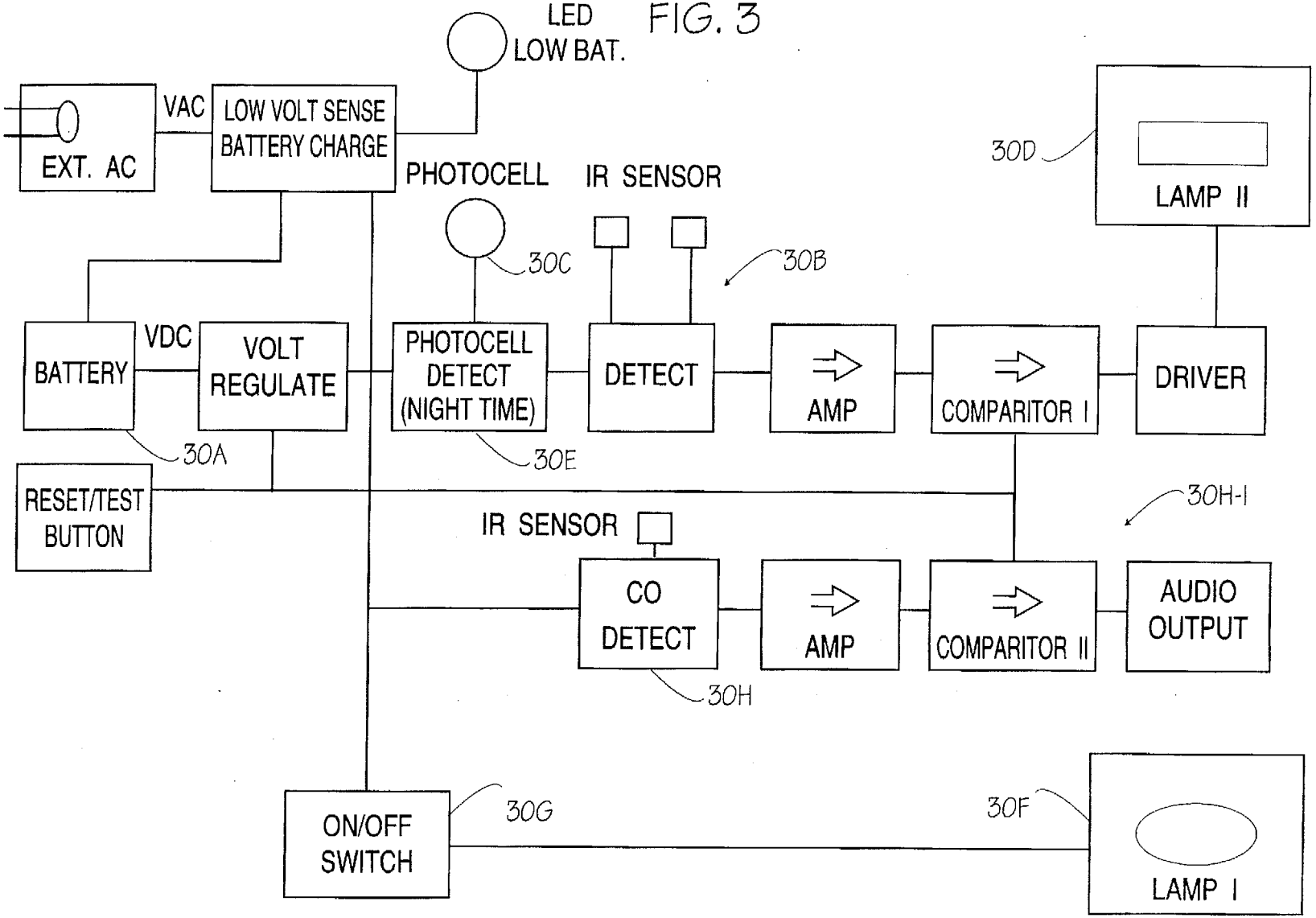
FIG. 3 is a schematic block diagram of an electrical circuit thereof.

The above described drawing figures illustrate the invention, a motion actuated night light device. The device includes a transparent or translucent housing 10 including a front face 10A and a housing peripheral edge 10B defining the extent of the housing. Preferably the housing 10 is made of optically clear polycarbonate plastic, but may also be made of translucent polycarbonate plastic, the plastic further preferably including a doping of a phosphorescent material so that the housing glows in the dark after being energized by the low level illumination. This feature is considered to be highly novel and very useful in that the housing glow enables one to find the device in total darkness and also acts as an aid in finding ones way in the dark. A wall mountable rear cover means 60 is engagable with the peripheral edge 10B of the housing 10 for closing the housing 10, i.e., establishing a closed space within. Such engagement may be by press fit, tongue-in-groove construction or other well known means. Within the housing 10, as best seen in FIG. 3, is mounted an electrical circuit means 30 including, as shown in FIG. 1, a circuit board 30-1, a means for energy storage 30A such as a battery or other electrical energy storage cell or cells, a means for motion sensing 30B such as an infra-red sensor or sensors, a means for detecting ambient light level 30C such as a photocell, and a means for low level illuminating 30D for producing a low level illumination. The various electrical elements which make up the circuit means are interconnected in a manner well known to those of skill in the art. Electrical elements not specifically claimed in the following Claims, but shown in FIG. 3 are considered to be of significant value and to be patently innovative in the present invention as well. The storage cell is preferably accessed via a removable battery cover 20 held in place by screws 50 such as shown in FIGS. 1 and 2. The front face 10A of the housing provides a portion as a downwardly directed surface 10A-1 for projecting light from the illuminating means 30D downwardly from the device for illuminating the floor in front of the device, for example. The front face 10A further provides opposing, laterally positioned and sideways directed portions as surfaces 10A-2 and 10A-3 for projecting light from the illuminating means 30D to each side of the device. The sideways directed surfaces 10A-2 and 10A-3 preferably further encompass the motion sensing means 30B such that motion is detectable over a 180 degree azimuth. To fully facilitate such an azimuth the motion sensing means 30B preferably includes a spherical Fresnel lens means 30B-1 preferably a pair of spherical Fresnel lenses positioned, one on either side of the device, as best seen in FIG. 1. The placement of downwardly and sidewardly directed surfaces in the manner shown in FIG. 1 is considered highly novel and inventive in the present embodiment in that it efficiently directs light in a manner such that the very low level of light produced enables significant visibility of both the device itself and the surrounding area. This particular feature is not taught in the prior art in a low cost simple construction as taught in the present disclosure.

Therefore, the device may be mounted on a wall (not shown) in, for instance, a corridor or hallway, and the device is then able to detect personnel moving toward the device from either direction in the corridor. The electrical circuit means 30 further provides a means for automatically actuating 30E the illuminating means 30D upon detection of motion by the motion sensing means 30B, and for de-actuating the illuminating means after a set time period, typically 8 seconds, during which no motion is detected. The electrical circuit means 30 further preferably includes a means for high intensity illuminating 30F such as by one or more incandescent lamps. The purpose of this feature is to provide brighter illumination for emergency operation as the device may be taken from its mounting for use as a flashlight. For enabling this method of use the electrical circuit means preferably includes a power enabling switch 30G, the switch being positioned on the housing 10 for manual actuation. Preferably, the rear cover means 60 includes a bonding means 20A, a magnetic means or any other quick fastener method for attachment of the device to a wall so that the device is securely fastened, but may be removed in an emergency.

Preferably, the low level illuminating means 30D is an electro-luminescent light source configured as a thin contoured plate, the plate providing a shape corresponding to the inside surface of the front face 10A of the housing 10. This contoured plate is preferably positioned adjacent to the front face 10A and is interconnected with the electrical circuit means 30 for enabling this source to produce a low level illumination. The electro-luminescent light source may be coated with a phosphorescent material 30D-1 or alternately may be laminated to a phosphorescent layer so that the phosphorescent layer is energized by the light energy from the illuminating means 30D when it is turned on. The contouring of the plate enables the other components of the device to be compactly positioned within the housing so that the thickness of the housing is minimized. This is a great advantage as it has been found that protuberances mounted on the sides of corridor walls are often inadvertently struck by personnel or equipment when they protrude excessively.

The electrical circuit means 30 is preferably enabled for providing a pulsed electrical waveform to the low level illuminating means 30D for extending the life of the energy storage means 30A. Such a pulsed operation does not materially lower the illumination level of the low level illuminating means 30D in that during the off times of the pulsed signal, the residual dwell time of the electro-luminescent source continues to emit light, the next pulse arriving just prior to the overall light output dropping by a noticeable amount.

The device may further be provided with an indicia 40 on the front face 10A, such indicia being visible when the low level illumination is active. Such an indicia may be a logo, a written message such as "Exit door is located on the 2 $^{nd}$ level," or "Trust in the lord," or any other meaningful indicia. Also, the front face may be configured with a series of vertical chevrons or peaks protruding outwardly so as to improve the visibility of the device from either side.

FIG. 3 describes the preferred circuit for enabling the invention although one of skill in the art will be able to enable the functions of the invention through other circuit configurations. Notice that a sensor 30H and audio output means 30H-1 may also be included in the electrical circuit of the device. Such a capability might be sensitive to high heat, smoke, carbon monoxide gas, or any other one, or combination of sensible conditions in the ambient environment of the device. In the event of the detection of a harmful condition, an audio alarm means 30H-1 would provide an audio output as a warning signal.

In use, as described above, one or more of the device is placed in a corridor, closet, hallway or any place that night light illumination is desired. The energy means 30A provides power to the low level illuminating means 30D whenever the ambient light level is such as to indicate that added illumination is desired and then, only if motion is detected. If motion is not detected then the illumination remains in an off state. When motion is detected, the illuminating means is energized so as to produce a low level illumination. However, if the ambient lighting is above a specified level, the low level illuminating means is not switched on even if motion is detected. When motion is no longer detected for a specified period of time, illumination is once again turned off. Even with the illumination off, the device provides a small amount of lighting from the phosphorescent material in the enclosure. In an emergency the device may be removed from its mounting and used as a flashlight by actuating the high intensity light capability of the device.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A motion actuated night light device comprising:

providing a transparent front face and a housing peripheral edge, wherein the housing includes a doping of a phosphorescent material so that the housing glows in the dark when energized by a low level illumination;

a wall mountable rear cover means engagable with the peripheral edge of the housing for enclosing the housing;

an electrical circuit means including a means for energy storage, a means for motion sensing, and a means for low level illuminating for producing low level illumination;

the front face of the housing providing a downwardly directed surface for projecting light from the illuminating means downwardly from the device, the front face further providing opposing, laterally positioned and sideways directed surfaces for projecting light from the illuminating means to each side of the device; the sideways directed surfaces further encompassing the motion sensing means such that motion is detectable over a 180 degree azimuth;

the electrical circuit means further providing a means for automatically actuating the illuminating means upon detection of motion by the motion sensing means, and for de-actuating the illuminating means after a set time period during which no motion is detected.

2. The device of claim 1 further including a means for high intensity illuminating.

3. The device of claim 1 wherein the housing is made of optically clear polycarbonate plastic.

4. The device of claim 1 wherein the front face provides an indicia visible when the low level illumination is present.

5. The device of claim 1 wherein the electrical circuit further includes a power enabling switch, the switch positioned on the housing for manual actuation.

6. The device of claim 1 wherein the motion sensing means includes a spherical Fresnel lens means.

7. The device of claim 1 wherein the rear cover means includes a bonding means for attachment of the device to a wall.

8. The device of claim 1 wherein the rear cover means includes a magnetic means for attachment of the device to a wall.

9. The device of claim 1 wherein the low level illuminating means is a thin plate, the plate providing a shape corresponding to an inside surface of the front face of the housing and positioned adjacent thereto, the plate being formed as an electro-luminescent light source and interconnected with the electrical circuit means for enabling the coating to produce said low level illumination.

10. The device of claim 9 wherein the electrical circuit means is enabled for providing a pulsed electrical waveform to the low level illuminating means for extending the life of the energy storage means.

11. A motion actuated night light device comprising:

a housing providing a transparent front face and a housing peripheral edge, wherein the housing includes a doping of a phosphorescent material so that the housing glows in the dark when energized by a low level illumination; an electrical circuit means within the housing, including a means for energy storage, a means for motion sensing, and a thin plate having a shape corresponding to an inside surface of the front face of the housing and positioned adjacent thereto, the plate being formed as an electro-luminescent light source and interconnected with the electrical circuit means for producing the low level illumination;

the front face of the housing providing a downwardly directed surface for projecting light downwardly from the device, the front face further providing opposing, laterally positioned and sideways directed surfaces for projecting light to each side of the device;

the sideways directed surfaces further encompassing the motion sensing means such that motion is detectable over a 180 degree azimuth;

the electrical circuit means further providing a means for automatically actuating the light source upon detection of motion by the motion sensing means, and for de-actuating the light source after a set time period during which no motion is detected.

12. The device of claim 11 wherein the electrical circuit means is enabled for providing a pulsed electrical waveform to the light source for extending the life of the energy storage means.

13. A motion actuated night light device comprising:

a housing providing a transparent front face and a housing peripheral edge, wherein the housing is made of translucent plastic including a doping of a phosphorescent material so that the housing glows in the dark when energized by low level illumination;

an electrical circuit means including a means for energy storage, a means for motion sensing, and a means for low level illuminating for producing a low level illumination; the front face of the housing providing a downwardly directed surface for projecting light from the illuminating means downwardly from the device, the front face further providing opposing, laterally positioned and sideways directed surfaces for projecting light from the illuminating means to each side of the device; the sideways directed surfaces further encompassing the motion sensing means such that motion is detectable over a 180 degree azimuth;

the electrical circuit means further providing a means for automatically actuating the illuminating means upon detection of motion by the motion sensing means, and for de-actuating the illuminating means after a set time period during which no motion is detected.

* * * * *